US007849974B2

(12) United States Patent
Stanley et al.

(10) Patent No.: US 7,849,974 B2
(45) Date of Patent: Dec. 14, 2010

(54) METHOD OF DISPATCHING AN ELEVATOR CAR

(75) Inventors: Jannah A. Stanley, Cromwell, CT (US); Hideyuki Honma, Chiba-ken (JP); Daniel S. Williams, Southington, CT (US); Theresa Christy, West Hartford, CT (US); Thomas W. Saxe, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 628 days.

(21) Appl. No.: 11/908,505

(22) PCT Filed: Dec. 20, 2005

(86) PCT No.: PCT/US2005/045948

§ 371 (c)(1),
(2), (4) Date: Sep. 13, 2007

(87) PCT Pub. No.: WO2006/101552

PCT Pub. Date: Sep. 28, 2006

(65) Prior Publication Data

US 2009/0120726 A1 May 14, 2009

Related U.S. Application Data

(60) Provisional application No. 60/663,242, filed on Mar. 18, 2005.

(51) Int. Cl.
*B66B 1/18* (2006.01)

(52) U.S. Cl. ..... 187/387; 187/391

(58) Field of Classification Search ..... 187/247, 187/380–388, 391–393, 396
See application file for complete search history.

(56) References Cited

U.S. PATENT DOCUMENTS

| | | | |
|---|---|---|---|
| 5,092,431 | A | 3/1992 | Schroder |
| 5,192,836 | A | 3/1993 | Schroder |
| 6,853,920 | B2 | 2/2005 | Hsiung et al. |
| 6,905,003 | B2 | 6/2005 | Hirade |
| 6,945,365 | B2 * | 9/2005 | Matela ..... 187/382 |

(Continued)

FOREIGN PATENT DOCUMENTS

| | | |
|---|---|---|
| JP | 05004779 | 1/1993 |

(Continued)

*Primary Examiner*—Jonathan Salata
(74) *Attorney, Agent, or Firm*—Carlson, Gaskey & Olds PC

(57) ABSTRACT

An elevator system (20) includes a plurality of cars (22) and destination entry devices (40) located some distance from the elevator cars (22). A controller (38) dispatches an elevator car to a requested destination entered by a passenger before the passenger enters an elevator car. In one example, the controller (38) uses an expected arrival time corresponding to the time it is expected to take for a passenger to travel from the location where the destination request is entered to the location of the elevator car to decide how to dispatch a car to service that request. In one example, the controller dispatches an elevator car to the requested destination on a next trip of that car if the expected arrival time of the passenger near that car occurs at or before the departure time for that next trip. Otherwise, the controller (38) dispatches the car to the requested destination on a subsequent trip after the next trip.

11 Claims, 3 Drawing Sheets

U.S. PATENT DOCUMENTS

| | | | | |
|---|---|---|---|---|
| 7,328,775 | B2 * | 2/2008 | Zaharia et al. | 187/396 |
| 7,549,517 | B2 * | 6/2009 | Stanley et al. | 187/382 |
| 7,717,238 | B2 * | 5/2010 | Hamaji et al. | 187/396 |
| 2001/0035314 | A1 * | 11/2001 | Yoshida et al. | 187/382 |

FOREIGN PATENT DOCUMENTS

| | | |
|---|---|---|
| JP | 5139633 | 6/1993 |

* cited by examiner

METHOD OF DISPATCHING AN ELEVATOR CAR

This application claims priority to U.S. Provisional Application No. 60/663,242, which was filed on Mar. 18, 2005.

FIELD OF THE INVENTION

This invention generally relates to elevator systems. More particularly, this invention relates to dispatching elevator cars in an elevator system.

DESCRIPTION OF THE RELATED ART

Elevator systems are well known and in widespread use. Elevator cars carry passengers or cargo between various levels within a building, for example. Elevator systems come in a variety of configurations to meet the particular needs of a given building arrangement.

Many buildings, based upon the traffic volume for the building, require particular traffic control techniques to provide optimized passenger service. A variety of known techniques have been proposed. One example includes sectoring or channeling where one or more elevator cars are assigned to particular groups or sectors of floors. Another technique is known as destination entry. This technique includes having passengers enter a requested destination outside of elevator cars rather than using traditional car operating panels located inside the car to indicate their desired destination. While sectoring and destination entry systems provide advantages, those skilled in the art are always striving to provide improved passenger service and to address the needs of particular building situations.

For example, many destination entry systems rely upon locating kiosks in the vicinity of elevators so that the passengers are very near the elevators when they make their destination request. It is desirable to be able to allow passengers to place a destination request in other locations within a building. For example, it may be advantageous to have passengers place destination requests upon entering a building lobby level. For such situations, special accommodations must be made in the car dispatching algorithm because it will take time for the individual passenger to arrive at the elevator door sometime after entering the destination request.

One approach has been to extend the time that an elevator car waits with doors open to allow a passenger to arrive for entering the car. When the distance between the entry of the destination request and the actual elevator is significant, the wait time for that elevator to leave that level becomes undesirably long. As an elevator sits and waits with its doors open, the wait time for passengers already on the elevator increases. Increasing passenger wait time degrades the overall performance of a dispatching technique that is intended to reduce wait times.

There is a need for a technique to accommodate destination entry requests made a considerable distance away from the entrance to an elevator car. This invention addresses that need.

SUMMARY OF THE INVENTION

An exemplary disclosed method of dispatching an elevator car to a destination requested by a passenger before the passenger enters the car includes dispatching the elevator car to the requested destination during a trip that begins at a time corresponding to an expected arrival time when the passenger is expected to arrive at the elevator car.

One example includes selecting one of a next trip of the elevator car or a subsequent trip of the elevator car after the next trip. Selecting the next trip or the subsequent trip depends upon a departure time when the elevator car will begin the next trip and a relationship between the departure time and the expected arrival time of the passenger near the elevator car.

In one example, whenever the expected arrival time is before the departure time for the next trip, the elevator is dispatched to the requested destination during the next trip. Whenever the expected arrival time is after the departure time for the next trip, the elevator is dispatched to the requested destination during the subsequent trip.

One example includes continuously monitoring the departure time of the next trip and adjusting whether the elevator car is dispatched on the next trip or the subsequent trip whenever a change in the relationship between the next trip departure time and the expected arrival time will better accommodate the passenger.

The various features and advantages of this invention will become apparent to those skilled in the art from the following detailed description. The drawings that accompany the detailed description can be briefly described as follows.

DETAILED DESCRIPTION OF THE PREFERRED EMBODIMENTS

This invention provides an improved way of dispatching elevator cars to destinations requested by passengers before they enter the car. The disclosed example accommodates situations where the destination request is made some distance from an entry to an elevator car that will travel to the requested destination. The disclosed example allows time for a passenger to travel to the elevator car and assigns an appropriate elevator car to carry that passenger to the requested destination based upon the expected arrival time of the passenger near the elevator car in a manner that maintains elevator system efficiency.

Figure 1:
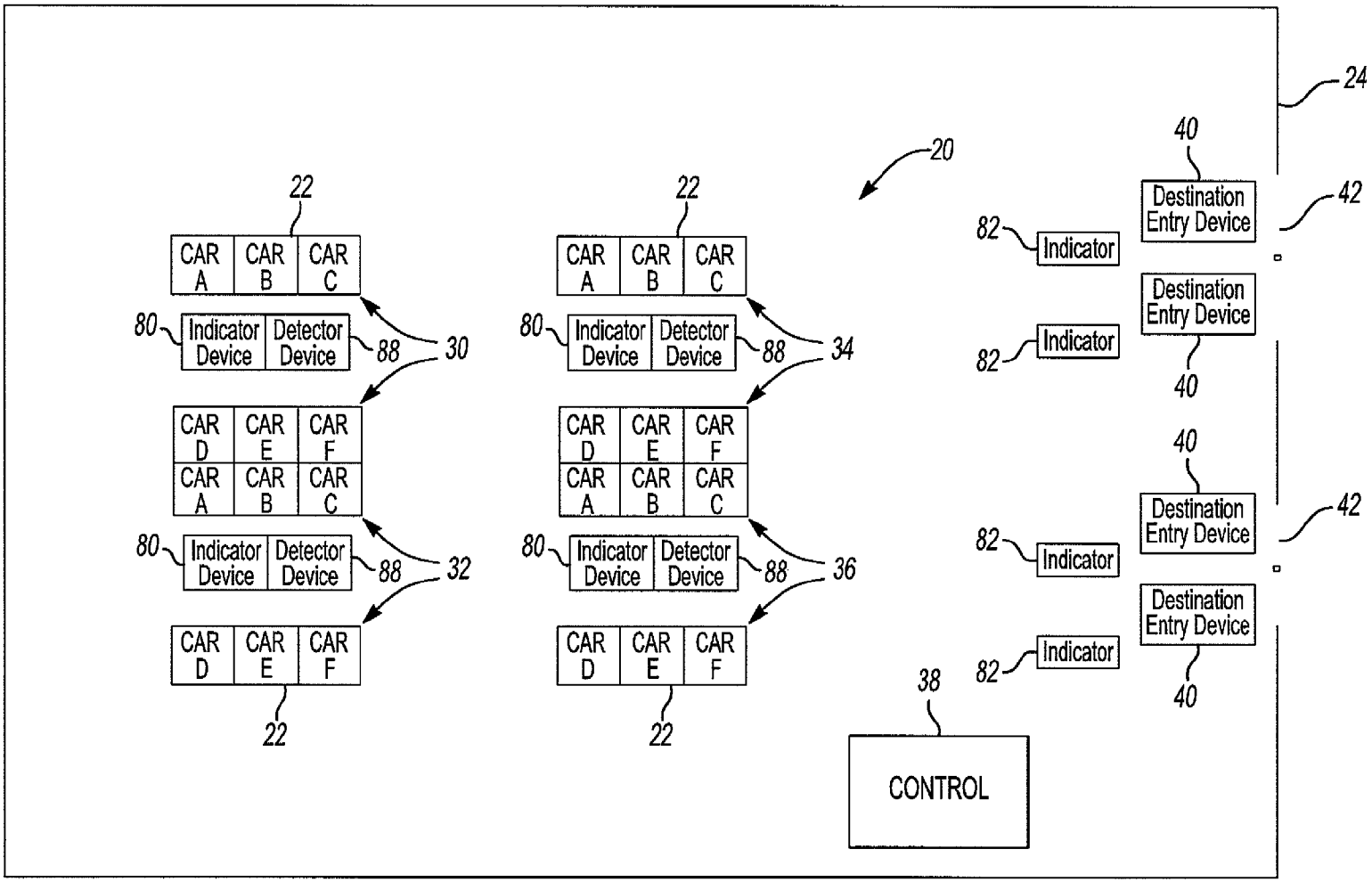
FIG. 1 schematically shows selected portions of an elevator system designed according to an embodiment of this invention.

FIG. 1 schematically shows selected portions of an example elevator system 20 that includes a plurality of elevator cars 22 for carrying passengers between various levels within a building 24. In the illustrated example, the elevator cars 22 are grouped into several groups. The illustrated example includes a first group 30, a second group 32, a third group 34 and a fourth group 36. Each of the groups in the illustrated example includes six elevator cars 22. A controller 38 utilizes known techniques for deciding how to dispatch the cars according to a selected dispatching algorithm. One example includes assigning each of the groups of elevator cars to a particular sector or group of floors within the building 24.

Only one controller 38 is shown for discussion purposes. Some examples include group controllers for the respective elevator groups. The described functions of the example controller may be accomplished through various combinations of software, firmware, hardware and processors.

The controller 38 accommodates destination requests made by passengers before they enter an elevator car 22. In the illustrated example, destination entry devices 40 are associated with turn styles or security devices located near entrances 42 to the building 24. A variety of known techniques for a passenger to enter a destination request at one of the destination entry devices 40 may be used. One example includes obtaining information from a building access card that provides an indication to the controller 38 of a destination (i.e., floor level) desired by the particular individual possessing that building access card. Such an example accommodates, for example, integrating elevator system control into a building access or security system.

The controller 38 receives destination requests and responsively assigns an appropriate elevator car 22 to carry passengers to the requested destinations. The controller 38 utilizes a dispatching technique that includes accommodating the time it takes for the passenger to travel from a destination entry device 40 to the location of the appropriate elevator car. In some instances there may be more than thirty meters between the destination entry devices 40 and the elevator cars. Rather than holding an elevator car with its doors open waiting for such a passenger, one example utilizes an expected arrival time when the passenger will arrive near the elevators to determine when to dispatch an elevator car to the requested destination. In one example, the controller 38 dispatches an elevator car 22 to a destination requested by a passenger during a trip that begins at a time corresponding to the expected arrival time of the passenger near the elevator.

In one example, the controller 38 determines whether the next trip of an elevator car or a subsequent trip after the next trip will be best to accommodate the passenger's request and maintain the passenger flow efficiency of the elevator system. For purposes of this discussion the elevator trips are assumed to begin from the level (e.g., a lobby floor) at which the passenger will access the elevator car. By selectively choosing which trip of an elevator car to use for dispatching the car to the requested destination, the controller 38 avoids having cars sitting at a lobby level, for example, with the doors open waiting for passengers to walk some distance between a destination entry device 40 and the appropriate elevator car 22.

Figure 2:
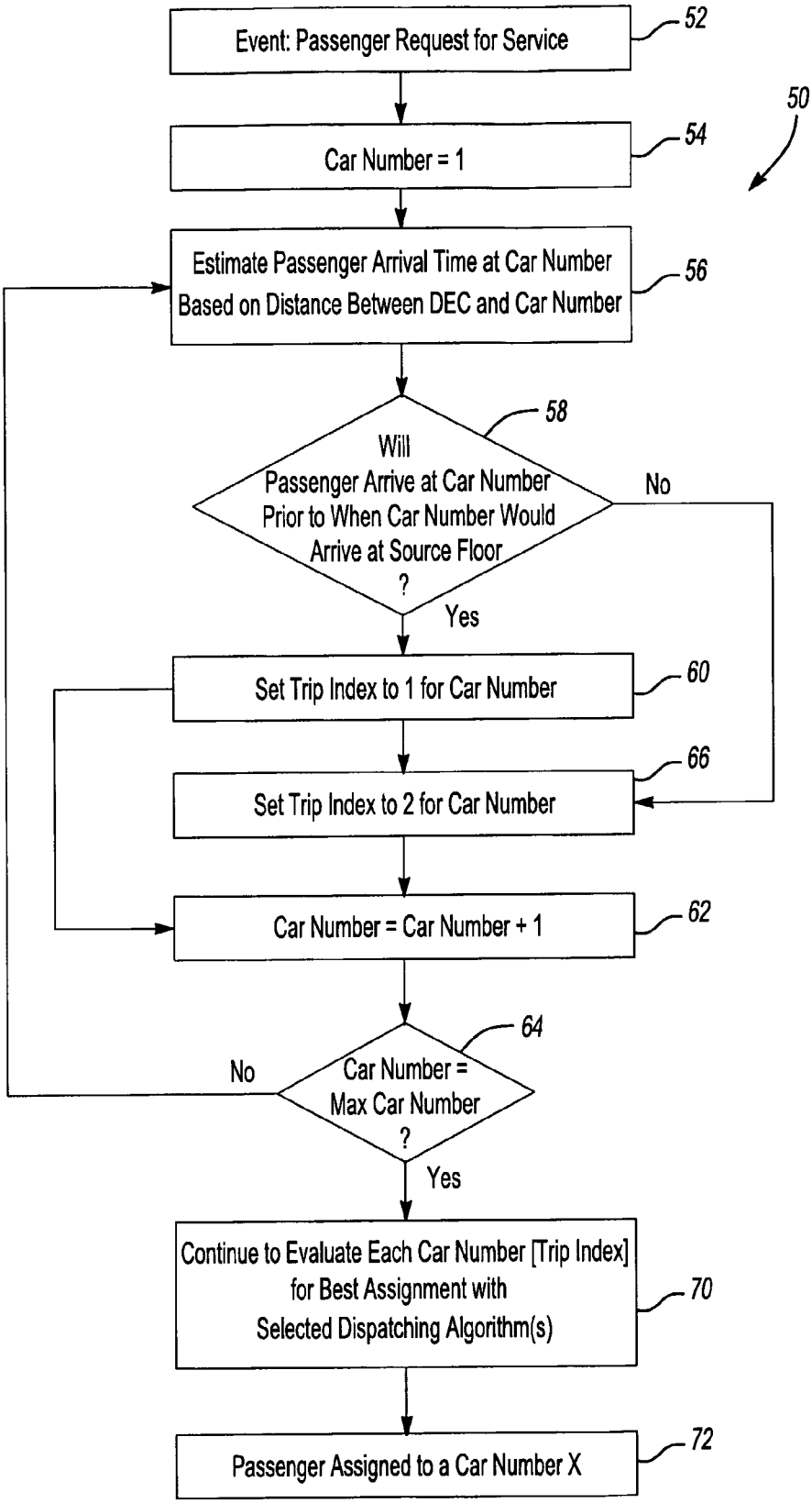
FIG. 2 is a flowchart diagram summarizing one example approach for dispatching an elevator car to a requested destination.

FIG. 2 includes a flowchart diagram that summarizes one example approach for selecting which trip of an elevator car will include a stop at a requested destination. The flowchart 50 begins at 52 where a passenger destination request has been received at one of the destination entry devices 40. The controller 38 determines which group of cars are candidate cars for serving that destination request. For purposes of discussion, the groups 30-36 of elevator cars are assigned to particular sectors within the building 24 and the controller 38 uses an appropriate group of cars, which is assigned to a sector including the requested destination, as the candidate cars to serve a particular request. It should be noted that this invention is not limited to arrangements that include sectoring techniques.

A first candidate car is considered at 54. The controller 38 determines an expected passenger arrival time near the first candidate car at 56. In one example, the controller 38 considers a distance between the candidate car and the destination entry device 40 at which the passenger request was received. A known distance between them and an expected or average pace for an individual to travel that distance allows the controller 38 to determine an expected arrival time of the passenger near the car.

Determining the expected arrival time in one example includes using one of a plurality of expected paces. In one example, a destination entry device allows for the controller 38 to obtain information regarding an individual's physical capabilities such as an indication that the person is wheelchair bound. The controller 38 in one example utilizes such information to select an appropriate expected pace for that passenger to travel to the location of an appropriate elevator car. Different travel paces may be selected for elderly individuals, physically challenged individuals, visually impaired individuals, among others, for example.

One example includes using one of a plurality of algorithms for determining the expected arrival time based upon at least one condition. A variety of conditions may affect the ability of a passenger to travel to the location of an elevator car. Example conditions include the time of day, a determined current elevator system traffic load, or an elevator system operation condition.

At 58, the controller 38 determines whether the passenger will arrive at the first candidate car before that car will arrive at the landing for receiving that passenger. In other words, the controller 38 determines whether the passenger is likely to arrive at the car location before the car arrives at that location.

When the determination at 58 is positive, at 60 a trip index for the first candidate car is set to 1. This corresponds to indicating that the first candidate car could carry the passenger to the requested destination during the next trip of that car departing from the landing where the passenger will enter the car. In other words, a trip index value of 1 in this example corresponds to a next trip of that car.

At 62, the process proceeds to increment a car number for considering a next candidate car. In the example of FIG. 1, there will be six candidate cars for an eligible group of candidate cars assuming that an entire group may service a requested destination. At 64, a decision is made whether all candidate cars have been evaluated. Assuming that they have not, the relationship between the expected arrival time of the passenger and a time that the next candidate car will arrive at the appropriate landing is determined at 56. This is followed by the determination made at 58. Assuming that the passenger is not expected to arrive at the location of the next candidate car before that car arrives at the landing to receive that passenger, at 66 the trip index for that candidate car is set to 2. In other words, if the passenger is not expected to arrive at the location of a car before that car arrives at the appropriate landing, a subsequent trip after the next trip of that car is used for carrying that passenger to the requested destination.

Once all candidate cars have been considered, the example process of FIG. 2 includes determining which candidate car would be the best assignment based upon a selected dispatching algorithm. For example, two candidate cars may have a trip index of one while other candidate cars have a trip index of two. The two candidate cars who could carry the passenger on the next trip of those cars would be preferable over cars that would make the passenger wait a longer time for service. This example includes making a choice between the two candidate cars that are capable of carrying the passenger on their next trip to provide service in an efficient manner. For example, one of those cars may arrive to receive the passenger first and be selected. In another example, selecting between two such candidate cars may depend on the expected number of stops the passenger will have to experience before arriving at their requested destination. Given this description, those skilled in the art will be able to select appropriate criteria for determining which candidate car to dispatch to the requested destination on the next trip of that car. Once the decision is made, the passenger assignment to the appropriate car is made at 72.

In one example, whenever a passenger is expected to arrive near an eligible candidate elevator car before the time that car is expected to depart from the corresponding landing (i.e., to begin its next trip), the car is dispatched or assigned to travel to the requested destination on the next trip of that car.

In one example, whenever the expected arrival time of the passenger is after a departure time when the car will begin the next trip departing from the corresponding landing, the controller 38 dispatches the elevator car to the requested destination on a subsequent trip after the next trip of that car. In one example, the departure time of a car for a trip is considered as the time that the car doors close just prior to leaving the landing where the passenger will enter the car.

One example includes determining if the expected arrival time of the passenger is within a selected window of the departure time for an elevator car. In one example, the door closing of the elevator car may be delayed up to a few seconds if the expected arrival time of a passenger near that car is within a few seconds of the departure time otherwise scheduled for that car. Providing a slight delay under some circumstances may slightly increase the wait time of some passengers on the car but decrease the wait time of others and, therefore, not have a significantly negative impact on the overall efficiency of the elevator dispatching system.

One example includes determining the departure time for the next trip of the elevator car based upon a current position and status of the elevator car. The status of the elevator car may include at least one of a current load carried by the elevator car, a current travel schedule for the elevator car (e.g., a sequence of stops the elevator car must make before arriving at the landing to receive the passenger) and an operational speed of the elevator car. In one example, if an expected arrival time does not occur in time for a next trip or a subsequent trip to accommodate a passenger, the following subsequent trip may be considered in a cyclical manner until the passenger request is accommodated.

Once the appropriate car is assigned to be dispatched to the requested destination, an indicator such as a visual display or an audible device provides an indication to the passenger regarding the assigned car. In the illustrated example, one such device near the appropriate elevator car is schematically shown at 80 in FIG. 1. The example of FIG. 1 also includes indicators 82 near the destination entry devices 40 that provide an indication to direct a passenger to the appropriate car that is assigned to carry them to their requested destination.

One example includes continuously determining a relationship between the expected arrival time of the passenger and the departure time of at least one elevator car for purposes of updating the car trip assignment if desirable. In one example, an actual arrival time of the passenger is determined utilizing a known device for receiving an indication that the passenger is near the elevator. One example includes providing a device 88 near an elevator car at which a passenger can be detected for indicating that they have arrived at that location. One example includes an electronic tracing or sensing device for detecting the location of an electronic card or badge carried by a passenger. Another example includes using video monitoring to determine when a particular passenger has arrived near an elevator car. If the actual arrival time of the passenger differs from the expected arrival time, the actual arrival time is substituted into the decision making process for deciding which trip of the assigned car will include that passenger.

Figure 3:
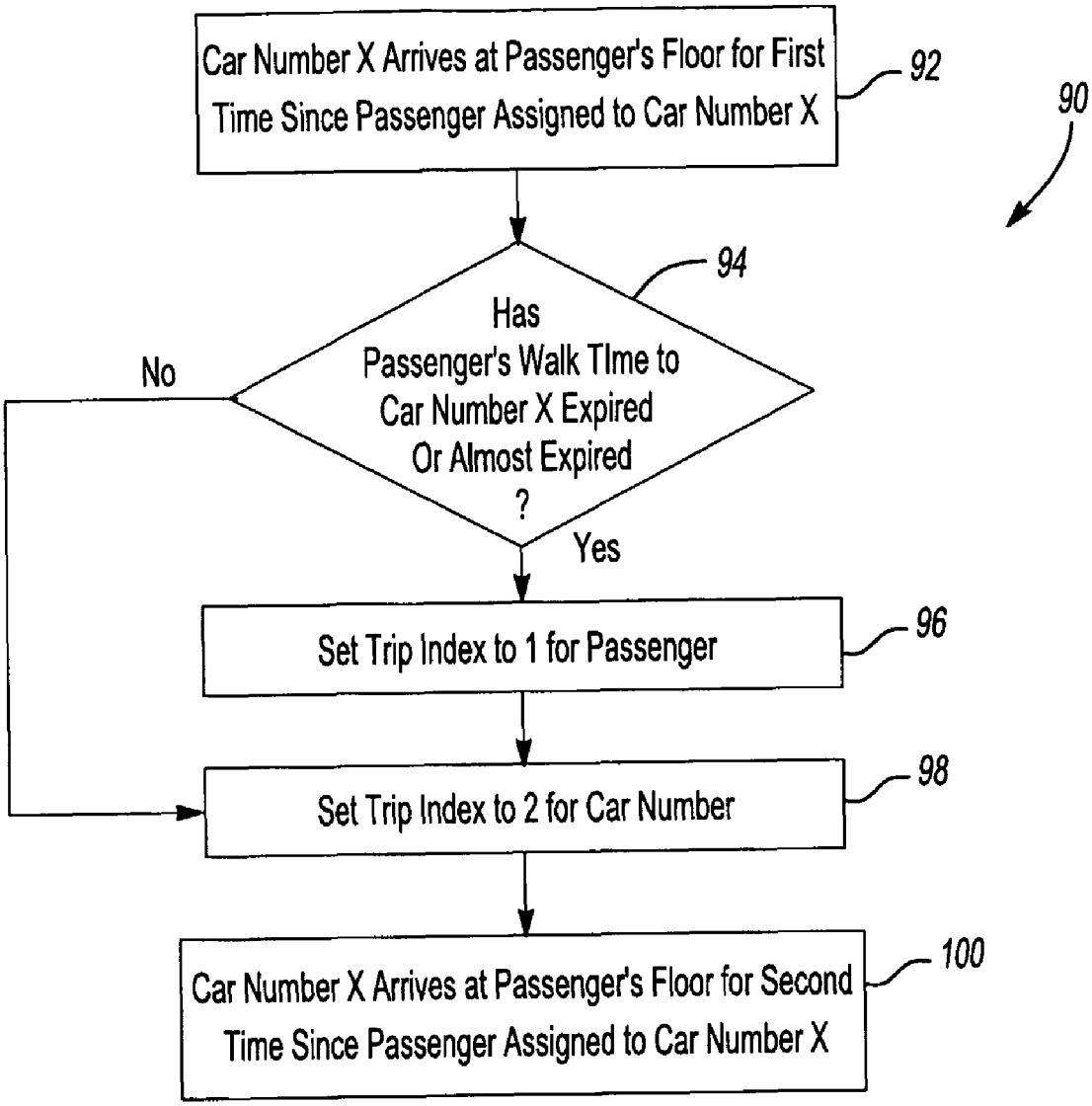
FIG. 3 is a flowchart diagram summarizing an example feature of one example embodiment.

Another example includes repeatedly monitoring or determining a relationship between a departure time of a car and the expected arrival time of the passenger to decide whether elevator system conditions have changed such that a better trip assignment could be made. FIG. 3 includes a flowchart diagram 90 that summarizes one example approach. A car that has been assigned to be dispatched to the requested destination arrives at the appropriate floor for the first time since that assignment was made at 92. At 94, the controller 38 determines whether the expected arrival time has passed or is about to occur at 94. If the expected arrival time has passed, the next trip of that car is used as the trip during which the car is dispatched to the requested destination. The flowchart in FIG. 3 shows this at 96 where the trip index is set to 1 for that car and that passenger.

If the expected arrival time has not passed or is not about to occur, the trip index is set to 2 for that car and that passenger at 98. By setting the trip index to 2 in this example, the subsequent trip of the car after the next trip will be used for carrying that passenger to that requested destination. At 100, the car arrives at the appropriate floor for the second time since the passenger was assigned to that car (e.g., arrives for purposes of beginning the subsequent trip).

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of dispatching an elevator car to a destination requested by a passenger before the passenger enters the car, comprising:

dispatching the elevator car to the requested destination during a trip that begins at a time having a desired relationship to an expected arrival time when the passenger is expected to arrive near the elevator car; and selecting one of a next trip of the elevator car or a subsequent trip of the elevator car after the next trip based upon an expected departure time for the elevator car to begin the next trip and a relationship between the expected departure time and the expected arrival time.

2. The method of claim 1, comprising determining the departure time for the next trip based upon a current position and status of the elevator car.

3. The method of claim 2, comprising determining the current status of the elevator car by determining at least one of a current load carried by the elevator car or a current travel schedule for the elevator car before the car will arrive at a landing from which the car will depart to begin the next trip.

4. The method of claim 1, comprising selecting the next trip if the expected arrival time is before the departure time for the next trip.

5. The method of claim 1, comprising selecting the next trip if the expected arrival time is after the departure time for the next trip and within a selected window of the departure time for the next trip; and adjusting the departure time to accommodate the expected arrival time for allowing the passenger to enter the car before the departure time.

6. The method of claim 1, comprising selecting the subsequent trip if the expected arrival time is after the departure time for the next trip.

7. The method of claim 6, comprising determining an updated departure time for the next trip and selecting the next trip if the expected arrival time is before the updated departure time.

8. The method of claim 1, wherein the departure time for the car to begin the next trip corresponds to a time that doors of the elevator car are closed for departing from a landing corresponding to a location where the passenger requested the destination.

9. The method of claim 1, comprising determining the expected arrival time based on a time that the destination is requested, a known distance between a location where the destination was requested and the elevator car and an expected pace for the passenger to travel to the elevator car.

10. The method of claim 9, comprising using a plurality of expected paces for a plurality of passengers, respectively.

11. The method of claim 1, comprising determining the time for the next trip to begin based upon a current position and status of the elevator car.

* * * * *